US012486728B2

(12) United States Patent
Gotlib et al.

(10) Patent No.: US 12,486,728 B2
(45) Date of Patent: Dec. 2, 2025

(54) PRODUCTION SELECTIVE LANDING TOOL

(71) Applicant: Schlumberger Technology Corporation, Sugar Land, TX (US)

(72) Inventors: Mikhail Gotlib, Houston, TX (US); Li Xue, Shanghai (CN); Yi Ming Zhao, Shanghai (CN); Kjell Revheim, Bucharest (RO); Thales De Oliveira, Abu Dhabi (AE)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/724,280

(22) PCT Filed: Jun. 22, 2023

(86) PCT No.: PCT/US2023/025911

§ 371 (c)(1),
(2) Date: Jun. 26, 2024

(87) PCT Pub. No.: WO2023/250050

PCT Pub. Date: Dec. 28, 2023

(65) Prior Publication Data

US 2025/0067139 A1 Feb. 27, 2025

Related U.S. Application Data

(60) Provisional application No. 63/366,807, filed on Jun. 22, 2022.

(51) Int. Cl.
*E21B 23/04* (2006.01)
*E21B 17/02* (2006.01)

(52) U.S. Cl.
CPC ..... *E21B 23/042* (2020.05); *E21B 17/026* (2013.01); *E21B 23/0418* (2020.05)

(58) Field of Classification Search
CPC ..... E21B 17/026
See application file for complete search history.

(56) References Cited

U.S. PATENT DOCUMENTS

2001/0009189 A1* 7/2001 Brooks ..... E21B 23/02 166/242.6
2003/0183388 A1* 10/2003 Toulouse ..... E21B 23/0411 166/117.6
2005/0006102 A1 1/2005 Cho
2005/0211441 A1 9/2005 Vold
2005/0279510 A1* 12/2005 Patel ..... E21B 33/12 166/380

(Continued)

*Primary Examiner* — Kristyn A Hall
(74) *Attorney, Agent, or Firm* — Jeffrey D. Frantz

(57) ABSTRACT

A method and apparatus for landing and orienting a production selective landing tool (PSLT) within a well casing. The well casing is provided with one or more indexing casing coupling (ICC). The PSLT is included in a completion string. The PSLT has several landing keys and an orientation key. The PSLT is conveyed through the casing and lands in the ICC. The PSLT has integrated control lines for intelligent completion. The PSLT has lugs coupled to a mandrel and control lines. The lugs, the mandrel and the control lines are shifted relative to the body of the PSLT. The control lines are in a slot of the body. The PSLT is locked in the ICC when the mandrel is shifted. The PSLT can be removed from the ICC via pulling the completion string uphole.

16 Claims, 3 Drawing Sheets

(56) References Cited

U.S. PATENT DOCUMENTS

| | | | | |
|---|---|---|---|---|
| 2011/0303419 | A1* | 12/2011 | Maier | E21B 33/126 166/373 |
| 2013/0327572 | A1* | 12/2013 | Sponchia | E21B 17/0283 175/73 |
| 2014/0014373 | A1 | 1/2014 | Richards | |
| 2020/0190928 | A1* | 6/2020 | King | E21B 29/002 |
| 2021/0293109 | A1 | 9/2021 | Kadam | |
| 2022/0106858 | A1 | 4/2022 | Garay | |

* cited by examiner

PRODUCTION SELECTIVE LANDING TOOL

CROSS-REFERENCE TO RELATED APPLICATION

The present document is a national stage entry of PCT Application No. PCT/US2023/025911, which is based on and claims priority to U.S. Provisional Application Ser. No. 63/366,807, filed Jun. 22, 2022, which is incorporated herein by reference in its entirety.

BACKGROUND

Hydrocarbons can be produced through a wellbore in a subterranean formation. Typically, a wellbore is lined with a casing or liner. A tubing string can be located in the casing to facilitate the production of the hydrocarbons. Tools coupled to the tubing string can be placed at a selected depth and orientation with a landing sub coupled to the casing. The tubing string can have various control lines to operate the various tools connected to the tubing string. The control lines are subject to damage during the landing and/or orientating of the tool. The damage includes being cut or stretched. The control lines could be stretched or cut during rotation of the tool as the tool couples to the landing sub. Furthermore, the control line could be cut when the tool couples to the landing sub. Therefore, a system and method are needed to orient and couple a tool to a casing without damaging the control lines while locking the tool in the casing.

SUMMARY OF THE INVENTION

This invention relates generally to wells to produce petroleum products. More specifically the present invention concerns the provision of a method and apparatus for landing and orienting downhole tools at well depths established by an indexing casing coupling (ICC) (not illustrated) to enable the efficient conduct of subsequent downhole operations.

This invention relates to control lines contained in a downhole tool that are not damaged during the landing and orienting of the downhole tool in an indexing casing coupling connected to the casing.

The present invention provides a method and system having the principal function of positioning, orienting a tool relative to a selected landing and orienting coupling of the casing string of the well and locking the apparatus within a landing profile of the selected landing and orienting coupling without damaging control lines utilized by downhole tools. The downhole tools include inflow control devices or any tool that requires the use of a control line. The control lines can be electric, fiber optic, hydraulic or any other type of line that will send control signals to a downhole tool.

The present invention provides a method and system for retrieving the tool after the tool has been locked in the ICC of a casing string.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Turning now to the Figures, FIGS. 1-6 are views of the PSLT 18 according to one or more embodiments of the present disclosure. The PSLT 18 is similar to the landing tool described in U.S. Pat. No. 6,012,527, which is hereby incorporated by reference. The PSLT 18 works in combination with an ICC, which is part of the casing string, to enable the orientation and landing of the PSLT18 within an ICC of a casing string in a well so that associated tools supported and positioned can be effectively utilized for conducting downhole activities requiring orientation at a specified angle. The ICC upper and lower ends are in threaded connection with sections of the casing string. The ICC has a landing profile which engages landing keys 4 and an orientation key 5 of the PSLT.

Figure 1:
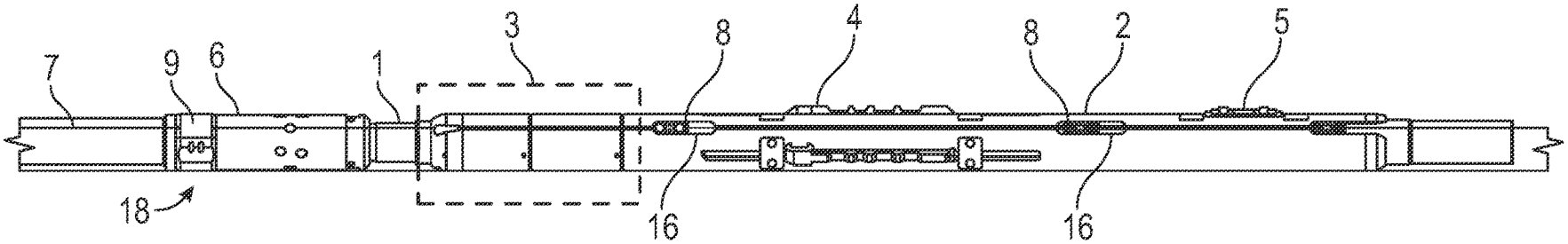
FIG. 1 is an overall view of a production selective landing tool (PSLT) according to an embodiment of the disclosure.

FIG. 1 is an overall view of the PSLT. The PSLT 18 includes a mandrel 1, a body 2, a locking module 3, landing keys 4, the orientation key 5, an angular adjustment device 6, control lines 7, lugs 8, and a clamp 9. The control lines 7 can be electric, fiber optic, hydraulic or any other type of line that will send control signals to a downhole tool. The control lines 7 are positioned in a slot 16 formed in the body 2, which continues through the locking module 3. The lug 8 is coupled to the mandrel 1 and positioned inside the slot 16 to support and retains the control lines 7. The clamp 9 is used to couple the control lines 7 to the angular adjustment device 6.

Figure 2:
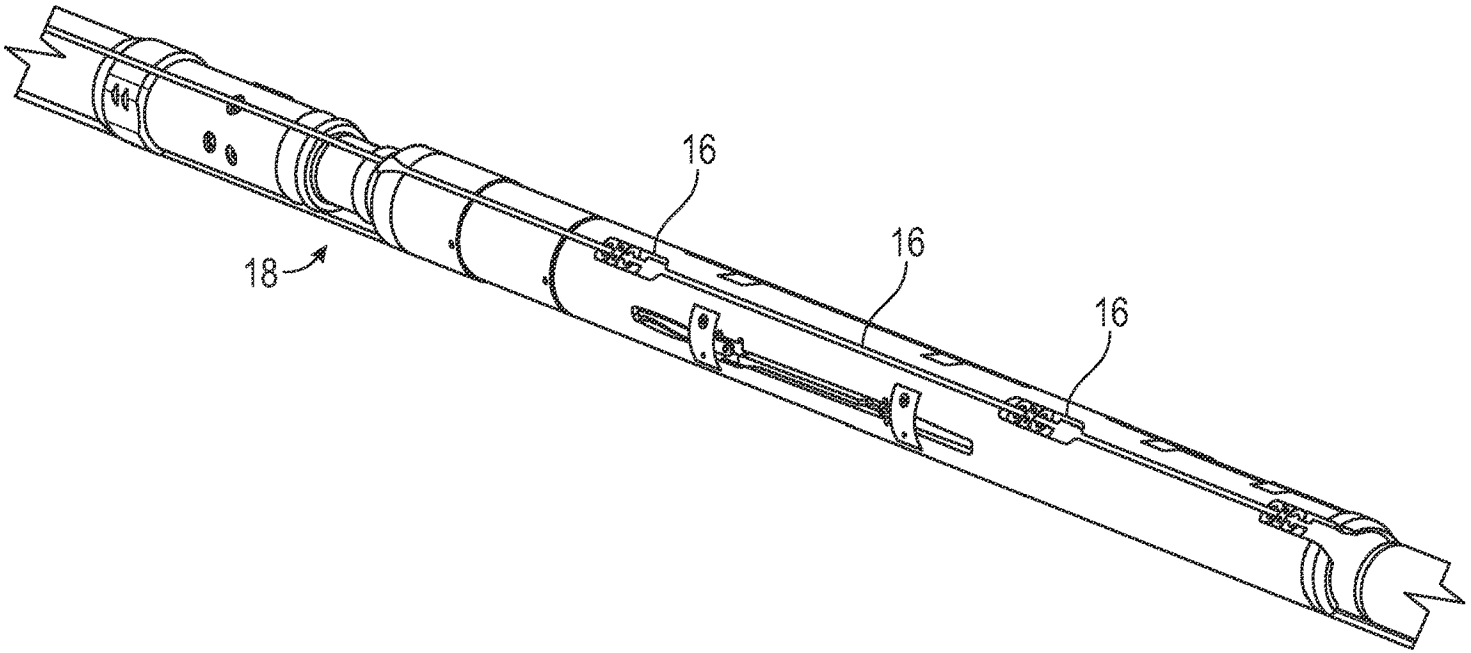
FIG. 2 is an overall view of the PSLT with the control line in the slot according to an embodiment of the disclosure.

FIG. 2 illustrates the control lines 7 in the slots 16 formed in the exterior of the body 2. The control lines 7 are held in place in the slots 16 by the lugs 8 and the clamp 9. The slots 16 have enlarged sections that support the lugs 8. The lugs 8 can slide with the enlarged section of the slots 16. The lugs 8 are coupled to the control lines 7 and the mandrel 1. The mandrel 1, lugs 8, and control lines 7 will all move together when the PSLT 18 is actuated.

Figure 3:
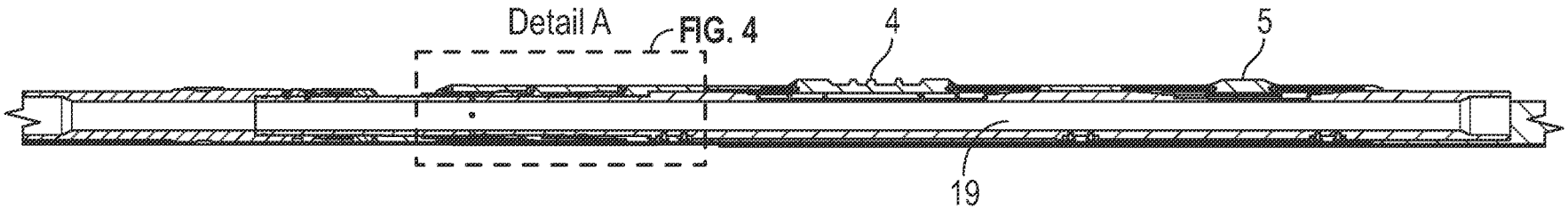
FIG. 3 is a cross-sectional of a section of the production selective landing tool of FIG. 1.

FIG. 3 is a cross-sectional view of a section of the PSLT 18 of FIG. 1. The mandrel 1 of the PSLT 18 has a bore 19 to allow fluid or other tools to pass through the PSLT 18. The PSLT 18 has a locking mechanism 3_that will be explained in detail below.

Figure 4:
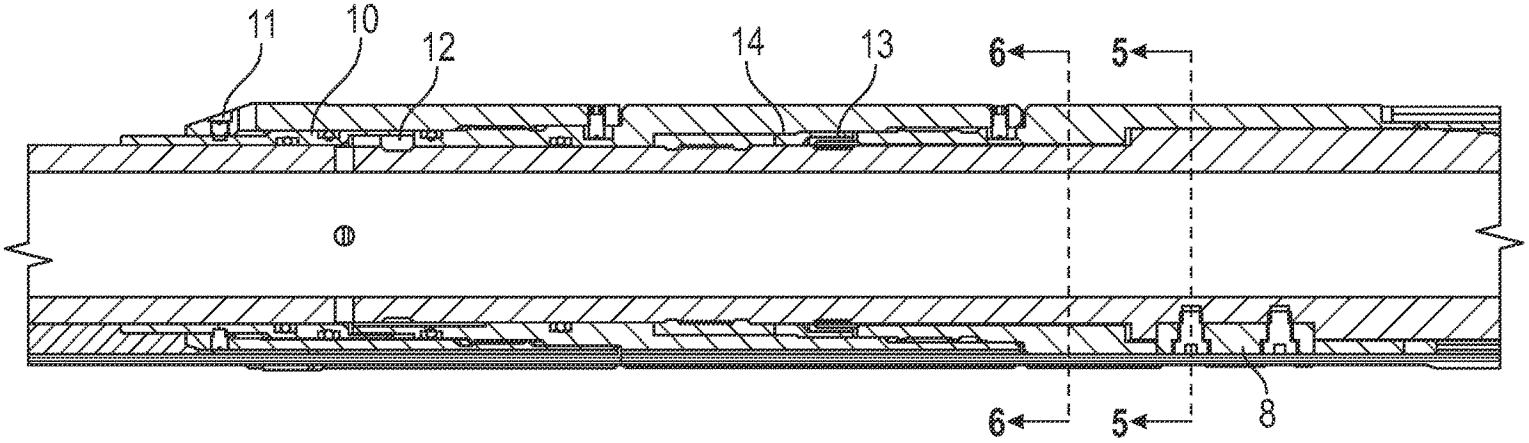
FIG. 4 is a cross-sectional of Detail A which is an enlarged view of the PSLT locking mechanism of FIG. 3.

FIG. 4 is a cross-sectional of Detail A which is an enlarged view of the PLST locking mechanism of FIG. 3. A locking lug 12 engages a groove in the outer surface of the mandrel 1. The locking lug 12 is retained in the groove in the outer surface of the mandrel 1 by a piston 10. The locking lugs 12 are compressed radially inward by the piston 10. The piston 10 surrounds the mandrel 1 and locking lugs 12. The piston 10 is retained in place by shear screws 11. Additionally, FIG. 4 illustrates a ratchet ring 13 and a shear ring 14. The ratchet ring 13 allows the mandrel 1 to move in only one direction. The ratchet ring 13 will interlock with ridges/teeth on the outer surface of the mandrel 1 when the mandrel 1 is shifted. The ratchet ring 13 will maintain the mandrel 1 in position once the mandrel 1 has been shifted.

Figure 5:
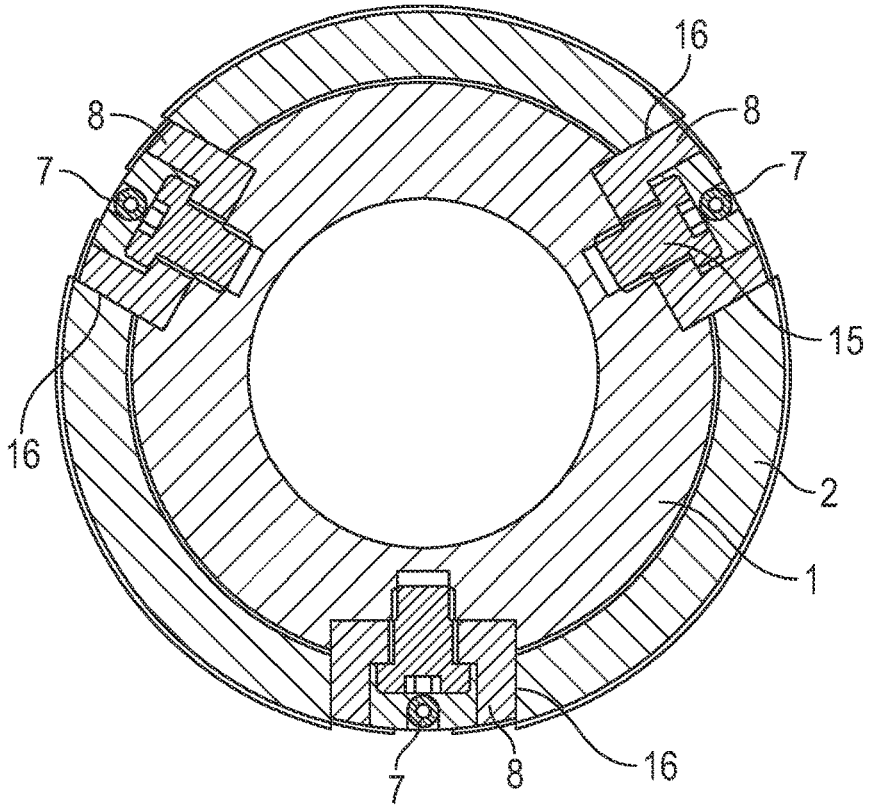
FIG. 5 is a cross-sectional of section B-B of the production selective landing tool of FIG. 4.

FIG. 5 is a cross-sectional of section B-B of the PSLT 18 of FIG. 4. FIG. 4 illustrates the body 2 located on the outer diameter of the mandrel (1). FIG. 4 illustrates three slots 16 in the body 2. The body 2 can have one or more slots 16 depending on the configuration. Inside the enlarged sections of the slots 16 are lugs 8 that are coupled to the control lines 7. The lugs 8 movement are contained by the enlarged sections of the slots 16. Additionally, screws 15 couple the lugs 8 to the mandrel 1, so when the mandrel 1 is shifted the screws 15 and lugs 8 will shift as well. The movement of the mandrel 1 is limited to the distance the lug 8 moves within the enlarged slot section of the slot 16 as illustrated in FIG. 2.

Figure 6:
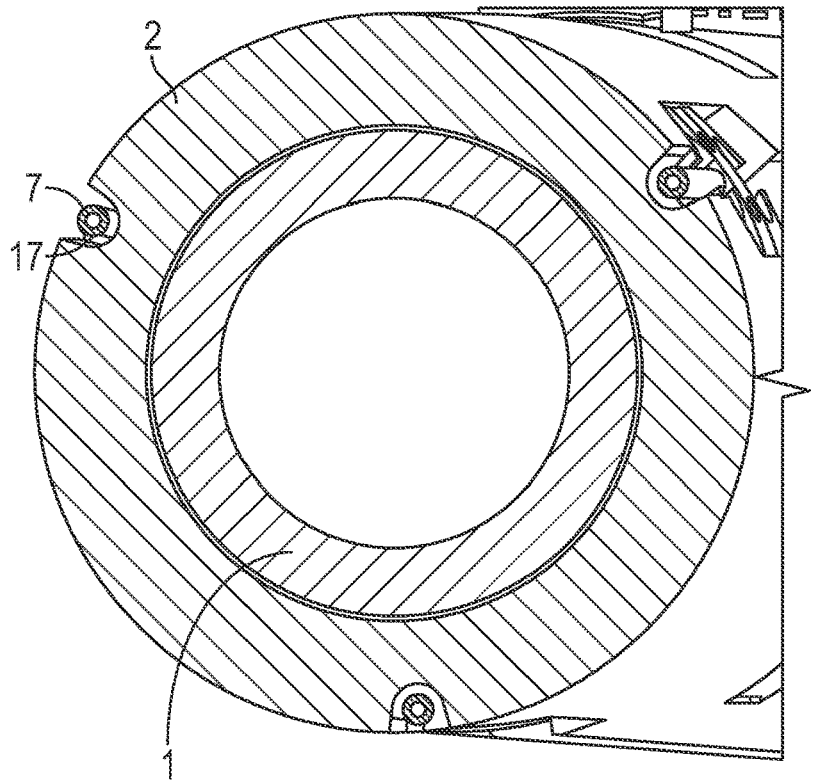
FIG. 6 is a cross-sectional of Section C-C of the production selective landing tool of FIG. 4.

FIG. 6 is a cross-sectional of Section C-C of the PSLT 18 of FIG. 4. FIG. 6 illustrates a space 17 between the control line 7 and the body 2. The control lines 7 never contact the body 2 before or after the PSLT 18 is actuated. The control lines 7 will slide with the mandrel since the lugs 8 are coupled to the mandrel 1 and control lines 7.

The PSLT 18 comprises the landing keys 4 which may be in the form of a plurality of landing keys 4 mounted on body 2. By way of example, the landing keys 4 may comprise three keys that, when assembled on body 2, match a corresponding latching profile of the ICC coupled to the casing.

The orientation key 5 of the PSLT 18 extends through an opening of the body 2. Once at the desired location, the orientation key 5 engages an orienting mechanism of the ICC, as described in greater detail below. The orienting mechanism enables rotational orientation of the PSLT 18.

In operation, the PSLT 18 is conveyed downhole on a completion string (not illustrated). Once downhole, the PSLT 18 is oriented and landed on the ICC latching profile. Once landed, slack-off weight and/or hydraulic pressure are applied to the PSLT 18. Once sufficient force, created by slack-off weight and/or hydraulic pressure, is applied to the PSLT 18, the piston 10 is shifted and shear screws 11 are sheared. When the piston 10 is shifted the exterior of the locking lug 12 will be uncovered. Once the shear screws 11 are sheared and the piston 10 is shifted, the locking lug 12 is expanded and the mandrel 1 can shift to support the landing keys 4 and the orientation key 5. The PSLT 18 scan support more than one locking lug 12. The ratchet ring 13 and shear ring 14 are used to maintain the mandrel 1 in the shifted position. The ratchet ring 13 and shear ring 14 lock the PSLT 18 in the ICC. As the mandrel 1, the lugs 8, and the control lines 7 are shifted as described above, while the body 2, the locking module 3, the landing keys 4, and the orientation key 5 remain stationary. The mandrel 1, the lugs 8, the clamp 9, and the control lines 7 are shifted together. Additionally, the lugs 8, the clamp 9, and the control lines 7 are shifted jointly. The PSLT 18 can then be released with via pulling the completion string uphole. The pulling of the completion string uphole shears the shear ring 14. Once the shear ring 14 is sheared, the ratchet ring 13 will no longer maintain the mandrel 1 in the shifted position, allowing the PSLT 18 to be removed from the ICC.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A production selective landing tool comprising:
a mandrel;
a body positioned around the mandrel;
control lines positioned within slots in the body;
lugs configured to retain the control lines against movement relative to the mandrel;
a plurality of landing keys; and
an orientation key,
wherein the plurality of landing keys and the orientation key facilitate orienting and positioning the production selective landing tool in an indexing casing coupling.

2. The production selective landing tool of claim 1, wherein the production selective landing tool is configured to be conveyed downhole by a completion string and lands in the indexing casing coupling connected to a casing string.

3. The production selective landing tool of claim 1, wherein the lugs are coupled to the mandrel and the control lines.

4. The production selective landing tool of claim 1, wherein the lugs are located in enlarged sections of the slots.

5. The production selective landing tool of claim 4, wherein the lugs, the mandrel and the control lines are shifted relative to the body.

6. The production selective landing tool of claim 1, further comprising a piston operable to engage one or more of the lugs, the piston being actuated by pressure, the pressure being one of a slack-off weight or a hydraulic pressure.

7. The production selective landing tool of claim 1, further comprising a locking lug to maintain the production selective landing tool in a run-in position.

8. The production selective landing tool of claim 1, further comprising a ratchet ring and a shear ring to maintain the production selective landing tool in an actuated position.

9. The production selective landing tool of claim 1, wherein the production selective landing tool can be removed from the indexing casing coupling.

10. A method comprising:

conveying a production selective landing tool downhole, the production selective landing tool comprising a mandrel, control lines, at least one locking lug locked in place by a piston, and shear screws, wherein the production selective landing tool is locked in a run-in position by the at least one locking lug; and landing the production selective landing tool on an indexing casing coupling within a wellbore; and applying at least one of a slack-off weight or hydraulic pressure to shift the piston and shear the shear screws to expand the at least one locking lug and unlock the production selective landing tool, wherein shearing the shear screws shifts the mandrel, the at least one locking lug, and the control lines relative to a body of the production selective landing tool.

11. The method of claim 10, wherein the production selective landing tool is conveyed downhole by a completion string.

12. The method of claim 10, wherein the at least one locking lug is coupled to the mandrel and the control lines.

13. The method of claim 12, wherein the control lines are in a slot of the body.

14. The method of claim 5, further comprising a ratchet ring and shear ring to maintain the production selective landing tool in an actuated position after the mandrel has been shifted.

15. The method of claim 10, further comprising attaching a plurality of landing keys and an orientation key of the production selective landing tool in the indexing casing coupling.

16. The method of claim 10, wherein the production selective landing tool can be removed from the indexing casing coupling by pulling a completion string uphole.

* * * * *